US012704249B2

(12) United States Patent
Hamdan

(10) Patent No.: US 12,704,249 B2
(45) Date of Patent: Aug. 11, 2026

(54) INDUSTRIAL SCALE POWER PLANT, A SYSTEM INCLUDING AN INDUSTRIAL SCALE POWER PLANT AND ONE OR MORE APPLIANCES, A CONVECTION OVEN, AND A HOT AND COLD THERMAL FLUID SUPPLY METHOD

(71) Applicant: Partners With Sun Inc., Richardson, TX (US)

(72) Inventor: Toufic Fawzi Hamdan, Mount Lebanon (LB)

(73) Assignee: Partners With Sun Inc., Richardson, TX (US)

( * ) Notice: Subject to any disclaimer, the term of this patent is extended or adjusted under 35 U.S.C. 154(b) by 0 days.

(21) Appl. No.: 19/119,818

(22) PCT Filed: Oct. 9, 2023

(86) PCT No.: PCT/NL2023/050524
§ 371 (c)(1),
(2) Date: Apr. 10, 2025

(87) PCT Pub. No.: WO2024/080865
PCT Pub. Date: Apr. 18, 2024

(65) Prior Publication Data

US 2026/0139826 A1 May 21, 2026

(30) Foreign Application Priority Data

Oct. 10, 2022 (NL) ..... 2033272

(51) Int. Cl.
*F22B 1/00* (2006.01)
*F01K 13/00* (2006.01)
*F01K 17/02* (2006.01)

(52) U.S. Cl.
CPC ..... *F22B 1/003* (2013.01); *F01K 13/00* (2013.01); *F22B 1/006* (2013.01); *F01K 17/02* (2013.01)

(58) Field of Classification Search
CPC .... F02C 1/05; F02C 6/16; F24S 20/20; F01D 15/10; F03G 6/04; F03G 6/06; F03G 6/111; F04B 35/04; F04B 37/12; F04B 41/02
See application file for complete search history.

(56) References Cited

U.S. PATENT DOCUMENTS 6,655,137 B1 * 12/2003 Sardari ..... F01N 3/26 60/285
7,877,999 B2 * 2/2011 Nuel ..... F03G 6/071 60/659
9,523,285 B2 * 12/2016 Heiligenstein ..... H02J 3/381
10,060,296 B2 * 8/2018 Friesth ..... F01K 3/00
(Continued)

*Primary Examiner* — Jesse S Bogue
(74) *Attorney, Agent, or Firm* — Schroeder Law PC

(57) ABSTRACT

The invention relates to a hybrid hydrogen thermo-electric multi-function industrial scale power plant, a system including such a power plant and connected appliances, a convection oven, and a hot and cold thermal fluid supply method. The invention uses a thermal fluid for heating, a thermal fluid for cooling, heat to both heat and cool the respective thermal fluids, a renewable or waste energy source to generate electricity, and hydrogen to store energy for both heating, cooling, and electricity. Ultimately, the invention allows to work off the grid on an industrial scale thereby having minimal environmental impact.

11 Claims, 6 Drawing Sheets

(56) References Cited

U.S. PATENT DOCUMENTS

| | | | | |
|---|---|---|---|---|
| 12,331,968 | B2 * | 6/2025 | Alazazmeh | C25B 1/04 |
| 2007/0012041 | A1 * | 1/2007 | Goldman | F03G 6/005 60/641.8 |

* cited by examiner

INDUSTRIAL SCALE POWER PLANT, A SYSTEM INCLUDING AN INDUSTRIAL SCALE POWER PLANT AND ONE OR MORE APPLIANCES, A CONVECTION OVEN, AND A HOT AND COLD THERMAL FLUID SUPPLY METHOD

BACKGROUND OF THE INVENTION

The invention relates to an industrial scale power plant with a reduced environmental impact by using renewable energy sources and/or waste energy sources. The invention further relates to the combination of an industrial scale power plant and one or more appliances powered by the industrial scale power plant, e.g. a convection oven. The invention also relates to a hot and cold thermal fluid supply method.

An industrial scale power plant is a system configured to provide a significant amount of energy for a production site, e.g. more than 10 GJ/hour, preferably more than 100 GJ/hour, more preferably more than 200 GJ/hour, and most preferably more than 300 GJ/hour, for instance 400 GJ/hour or even higher depending on the size and application.

To reduce the environmental impact of such power plants, it is known to use renewable energy sources and/or waste energy sources to provide a portion of the energy needed by the production site. A disadvantage of using renewable energy sources is that its energy output may vary significantly, for instance during the day due to changing weather conditions or the day-night rhythm but also from day to day. Hence, renewable energy sources are usually not reliable enough to provide sufficient power throughout the day and/or year.

CN114234278A is a patent publication disclosing a prior art system for heating and cooling a building throughout the year aiming at providing a reduced environmental impact while taking account of the varying availability of energy provided by renewable energy sources. However, a disadvantage of this system is that it requires a relatively large cross-season heat storage pool to be able to meet the heating demand throughout the year and that the temperatures used are relatively low thereby making this system only suitable for building heating and household use. Another disadvantage is that the efficiency of the cooling is relatively low and thus also only suitable for building cooling and household use. To meet energy demands on a larger industrial scale, the system would become unusably large.

SUMMARY OF THE INVENTION

In view of the above it is an object of the invention to provide an industrial scale power plant able to heat and cool which can meet a relatively large energy demand in an efficient way and with a minimal environmental impact.

According to a first aspect of the invention, there is provided an industrial scale power plant for providing hot thermal fluid at a temperature above 100 degrees Celsius, e.g. between 100 and 500 degrees Celsius, for heating purposes and for providing cold thermal fluid at a temperature of at most 10 degrees Celsius, e.g. between −60 and 5 degrees Celsius, for cooling purposes, said power plant comprising:

- a hot thermal fluid storage tank,
- a cold thermal fluid storage tank,
- a thermal fluid heating system for heating thermal fluid using a renewable energy source or waste energy source,

- an absorption or adsorption cooling system for cooling thermal fluid using a renewable energy source or waste energy source,
- an electricity generating system for converting energy from a renewable energy source or waste energy source into electricity,
- a battery system for storing electricity,
- a hydrogen storage tank,
- a hydrogen burner for converting hydrogen into heat,
- a hydrogen battery for converting hydrogen into electricity,
- a hydrogen generating system for converting electricity into hydrogen,
- a control system,
- a hot thermal fluid circulation system for circulating thermal fluid between the hot thermal fluid storage tank and the thermal fluid heating system for heating the thermal fluid in the hot thermal fluid storage tank, and
- a cold thermal fluid circulation system for circulating thermal fluid between the cold thermal fluid storage tank and the absorption or adsorption cooling system for cooling the thermal fluid in the cold thermal fluid storage tank, wherein the electricity generating system is configured to supply electrical components of the power plant with electrical power, wherein the battery system is connected to the electricity generating system to store excess electricity in the battery system and to supply electrical components of the power plant with electrical power in case the power generated by the electricity generating system is not sufficient, wherein the hydrogen generating system is connected to the electricity generating system to convert excess electricity into hydrogen, wherein the hydrogen storage tank is connected to the hydrogen generating system to store generated hydrogen, wherein the hydrogen burner is connected to the hydrogen storage tank to convert hydrogen into heat configured to be used to heat the thermal fluid in the hot thermal fluid storage tank and/or configured to drive the absorption or adsorption cooling system, wherein the hydrogen battery is connected to the hydrogen storage tank to convert hydrogen into electricity configured to supply electrical components of the power plant with electrical power, wherein the power plant further includes a hot thermal fluid outlet and a hot thermal fluid inlet connected to the hot thermal fluid storage tank to provide hot thermal fluid to an appliance, wherein the power plant also includes a cold thermal fluid outlet and a cold thermal fluid inlet connected to the cold thermal fluid storage tank to provide cold thermal fluid to an appliance, and wherein the control system is configured to control operation of the power plant, preferably, the control system is configured to control operation of the power plant to minimize environmental impact while being able to provide hot and cold thermal fluid at any desired time.

The invention according to the first aspect of the invention is based on the insight that storage of generated energy is key in developing an efficient and large capacity industrial power plant but also that this must be combined with a minimal number of energy conversions. The inventors have managed to do this by a) using a thermal fluid for heating and a thermal fluid for cooling thereby making use of the relatively large heat capacity of thermal fluids which also allows to get to higher temperatures, b) using heat to both heat and cool the respective thermal fluids, c) using a renewable energy source or waste energy source to generate electricity, and d) using hydrogen as a storage means for excess energy which hydrogen can be used for both electricity generation and heat generation. This results in an efficient use and storage of energy with minimal energy conversions that is suitable for relatively high temperature and energy demands.

In an embodiment, the fluid may be an oil, in which case the following phrases may be interchangeably used:

thermal fluid<->thermal oil
hot thermal fluid<->hot thermal oil
cold thermal fluid<->cold thermal oil
hot thermal fluid storage tank<->hot thermal oil storage tank
cold thermal fluid storage tank<->cold thermal oil storage tank
thermal fluid heating system<->thermal oil heating system
hot thermal fluid circulation system<->hot thermal oil circulation system
cold thermal fluid circulation system<->cold thermal oil circulation system etc.

In an embodiment, the fluid is a liquid, which may be a solid at room temperature, e.g. a molten salt.

In an embodiment, the thermal fluid heating system is configured to absorb solar heat for heating the hot thermal fluid.

In an embodiment, the absorption or adsorption cooling system is configured to absorb solar heat for driving the cooling system.

In an embodiment, the electricity generating system comprises solar panels, i.e. photovoltaic elements, to convert solar radiation into electricity.

In an embodiment, the thermal fluid heating system includes a solar concentrating device for directing solar radiation received at a first surface of a mirror or lens to a second surface in contact with the hot thermal fluid, which second surface is smaller than the first surface.

According to a second aspect of the invention, there is provided a system comprising:

one or more industrial appliances requiring heat to function,
an industrial scale power plant for providing heat to the one or more industrial appliances, wherein the industrial scale power plant includes:

a hot thermal fluid storage tank,
a thermal fluid heating system for heating thermal fluid using heat from a renewable energy source or waste energy source,
an electricity generating system for converting energy from a renewable energy source or waste energy source into electricity, which electricity generating system has a significant overcapacity,
a battery system for storing electricity,
a hydrogen storage tank,
a hydrogen burner for converting hydrogen into heat,
a hydrogen battery for converting hydrogen into electricity,
a hydrogen generating system for converting electricity into hydrogen,
a control system, and
a hot thermal fluid circulation system for circulating thermal fluid between the hot thermal fluid storage tank and the thermal fluid heating system for heating the thermal fluid in the hot thermal fluid storage tank to a temperature above 100 degrees Celsius, e.g. between 100 and 500 degrees Celsius, wherein the electricity generating system is configured to supply electrical components of the power plant with electrical power, wherein the battery system is connected to the electricity generating system to store excess electricity in the battery system and to supply electrical components of the power plant with electrical power in case the power generated by the electricity generating system is not sufficient, wherein the hydrogen generating system is connected to the electricity generating system to convert excess electricity into hydrogen, wherein the hydrogen burner is connected to the hydrogen storage tank to convert hydrogen into heat configured to be used to heat the thermal fluid in the hot thermal fluid storage tank, wherein the hydrogen battery is connected to the hydrogen storage tank to convert hydrogen into electricity configured to supply electrical components of the power plant with electrical power, wherein the one or more appliances are connected to the hot thermal fluid storage tank to receive and return hot thermal fluid while extracting heat from the hot thermal fluid, and wherein the control system is configured to control operation of the power plant, preferably to minimize environmental impact while being able to provide hot thermal fluid at any desired time, and to control the amount of heat provided to the one or more appliances.

In an embodiment, the one or more appliances include one or more of the following devices:

convection oven, preferably a convection oven according to a third aspect of the invention as described below,
grill,
rack oven,
fruit dehydrator,
oil fryer,
water heater and house heater,
heat electricity generator,
water desalination system,
fermentation room,
pasteurizer,
dairy and cheese making device,
eggs hatching machine,
bacterial incubator.

In an embodiment, the industrial scale power plant is an industrial scale power plant according to the first aspect of the invention, wherein preferably at least one of the one or more appliances are connected to the cold thermal fluid storage tank to allow to receive and return cold thermal fluid while transferring heat to the cold thermal fluid.

According to a third aspect of the invention, there is provided a convection oven comprising a first space and a second space separated from the first space via a wall, said first space being configured to support and hold items to be baked or heated, said second space being provided with a radiator for receiving hot thermal fluid to heat air in the second space, and said wall separating the first and second space including an opening provided with a ventilator to move air from the second space to the first space.

In an embodiment, the radiator has a U-shape in plan view with one leg extending adjacent a sidewall opposite the wall separating the first and second space and the other leg extending adjacent said wall separating the first and second space.

In an embodiment, the wall separating the first and second space includes a plurality of openings, each opening being provided with a ventilator to move air from the second space to the first space. The plurality of openings are preferably distributed substantially evenly over a length and/or width of the wall separating the first and second space.

In an embodiment, the ventilator is a centrifugal ventilator drawing in air in a radial direction and forcing air out in an axial direction.

In an embodiment, the radiator is configured to receive either hot thermal fluid to heat air in the second space or to receive cold thermal fluid to cool air in the second space.

In an embodiment, the radiator includes a plurality of radiator fins. The radiator may for instance include a plurality of tubes for the hot thermal fluid with the plurality of radiator fins fixed to the tubes. This has the advantage of increasing the surface area of the radiator for heat transfer to the air in the second space.

In an embodiment, the radiator includes one or more thermal masses to act as thermal buffers. This has the advantage of attenuating the effect of temperature fluctuations or variations of the thermal fluid in the radiator thereby improving the heat distribution in the second space to provide a homogenous temperature of the air in the second space and therefore also in the first space.

In in an embodiment, the one or more thermal masses are fixed to the plurality of radiator fins.

According to a fourth aspect of the invention, there is provided a method for providing hot and cold thermal fluid, said method comprising the following steps:

a. heating thermal fluid using heat from a renewable or waste energy source and storing the heated thermal fluid in a hot thermal fluid storage tank,
b. driving an absorption or adsorption cooling system with heat from a renewable or waste energy source to cool thermal fluid and storing the cooled thermal fluid in a cold thermal fluid storage tank,
c. generating electricity using a renewable or waste energy source, converting excess electricity into hydrogen, and storing the hydrogen in a hydrogen storage tank, and
d. in case heat from the renewable or waste energy source is insufficient for heating the thermal fluid, converting hydrogen from the hydrogen storage tank into heat for heating thermal fluid and storing the heated thermal fluid in a hot thermal fluid storage tank.

In an embodiment, the method further comprises the step of converting hydrogen from the hydrogen storage tank into heat for driving the absorption or adsorption cooling system or using heated thermal fluid from the hot thermal fluid storage tank for driving the absorption or adsorption cooling system in case the heat from the renewable or waste energy source is insufficient for driving the absorption or adsorption cooling system.

In an embodiment, the method further comprises the step of converting hydrogen from the hydrogen storage tank into electricity in case the generated electricity using the renewable or waste energy source is insufficient.

In an embodiment, the method is carried out by an industrial scale power plant according to the first aspect of the invention or a system according to the second aspect of the invention.

It is explicitly noted here that embodiments and/or features described in relation to one of the aspects of the invention may readily be applied as similar embodiments or features of other aspects of the invention where appropriate.

BRIEF DESCRIPTION OF THE DRAWINGS

The invention will now be described in a non-limiting way by reference to the accompanying drawings in which like parts are indicated by like reference symbols, and in which.

DETAILED DESCRIPTION OF THE INVENTION

Figure 1:
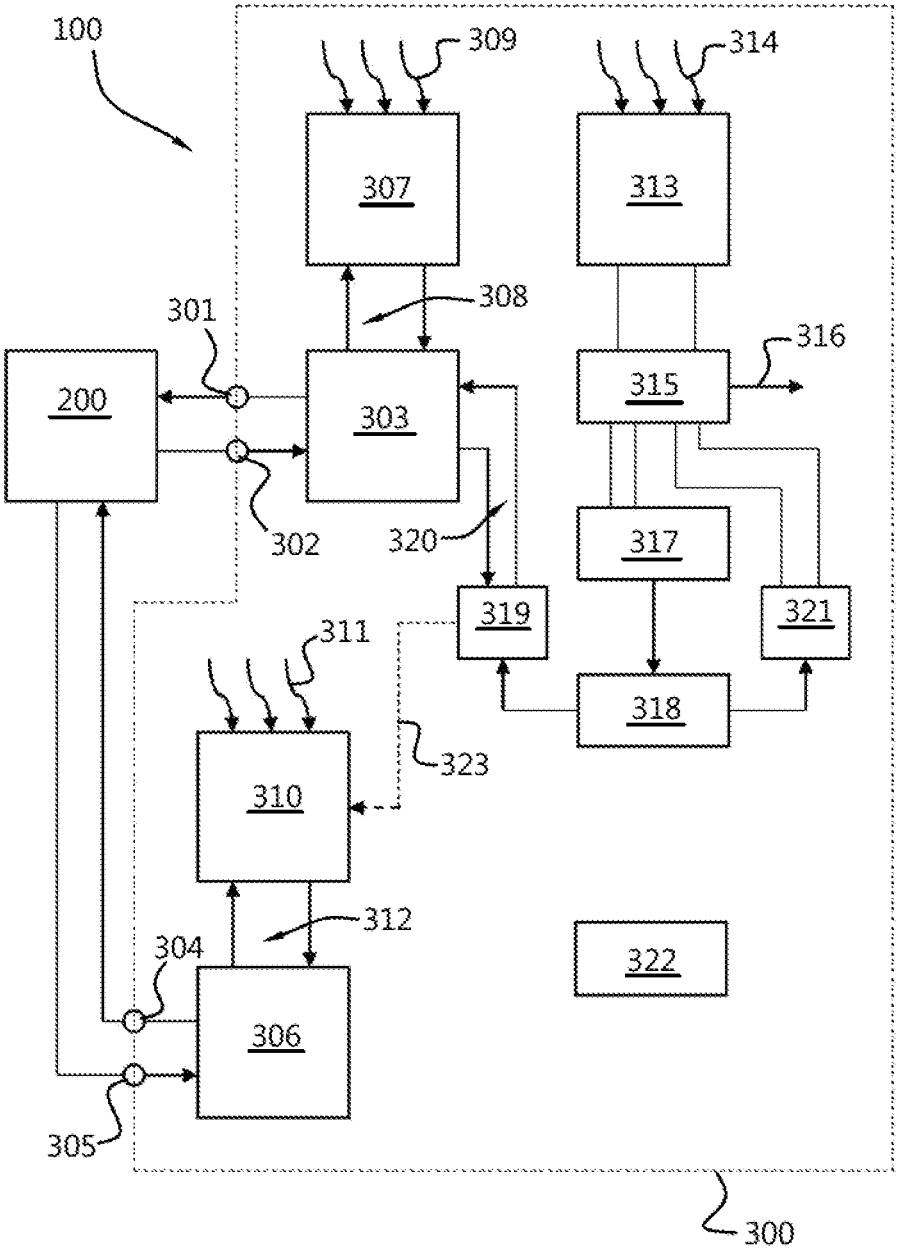
FIG. 1 schematically depicts a system according to a second aspect of the invention including an industrial scale power plant according to a first aspect of the invention, FIG. 2 schematically depicts a first cross-sectional view of a convection oven according to a third aspect of the invention, FIG. 3 schematically depicts a second cross-sectional view of the convection oven of FIG. 2, FIG. 4 schematically depicts a third cross-sectional view of the convection oven of FIG. 2, FIG. 5 schematically depicts a connection scheme for connecting the convection oven of FIG. 2 to the industrial scale power plant of FIG. 1, FIG. 6 schematically depicts another connection scheme for connecting the convection oven of FIG. 2 to the industrial scale power plant of FIG. 1, and FIG. 7 schematically depicts a detail of a convection oven according to another embodiment of the invention but similar to the convection oven of FIG. 2.

FIG. 1 schematically depicts a system 100 comprising one or more appliances 200 and an industrial scale power plant 300 for providing a hot thermal fluid, in this example a hot thermal oil, for heating purposes and a cold thermal fluid, in this example a cold thermal oil, for cooling purposes to the one or more appliances 200. In this embodiment, the system 100 is a system according to the second aspect of the invention, whereas the industrial scale power plant is a power plant according to the first aspect of the invention.

The one or more appliances 200 require heat to function and may for instance be or more of the following devices:

convection oven, e.g. a convection oven according to the third aspect of the invention,
grill,
rack oven,
fruit dehydrator,
oil fryer,
water heater and house heater,
heat electricity generator,
water desalination system,
fermentation room,
pasteurizer,
dairy and cheese making device,
eggs hatching machine,
bacterial incubator.

From now on, the one or more appliances 200 will be described as a single appliance 200 to make the description more eligible, but as the skilled person will understand, a plurality of appliances may be used in parallel, in series, or a combination thereof.

The power plant 300 includes a hot thermal oil outlet 301 and a hot thermal oil inlet 302 to connect the appliance 200 to a hot thermal oil storage tank 303. The power plant 300 further includes a cold thermal oil outlet 304 and a cold thermal oil inlet 305 to connect the appliance 200 to a cold thermal oil storage tank 306. It is explicitly noted here that the hot thermal oil outlet 301 and inlet 302 may be connected to one appliance, and the cold thermal oil outlet 304 and inlet 305 may be connected to a) the same appliance, b) another appliance, or c) are by default not connected to any appliance and used (and thus connected) occasionally when needed.

The hot thermal oil is circulated between the hot thermal oil storage tank 303 and the appliance 200 to provide heat to the appliance. The hot thermal oil preferably has a predetermined operating temperature above 100 degrees Celsius, e.g. between 100 and 500 degrees Celsius, for instance 300 degrees Celsius in the hot thermal oil storage tank 303 and is supplied to the appliance 200 for heat exchange. After exchanging heat with the appliance 200, the hot thermal oil returns to the hot thermal oil storage tank typically at a lower temperature in order to be heated again to the predetermined operating temperature. An advantage is that a thermal oil with a relatively high heat capacity can be chosen such that a lot of heat can be provided to the appliance without introducing a large temperature difference between the hot thermal oil entering the appliance 200 and the hot thermal oil leaving the appliance 200. This for instance aids in distributing heat in a homogenous manner to the appliance 200 and minimizes temperature differences.

To heat the hot thermal oil in the hot thermal oil storage tank 303 to the predetermined operating temperature and/or to maintain this temperature, a thermal oil heating system 307 for heating thermal oil using heat from a renewable energy source or waste energy source 309, and a hot thermal oil circulation system 308 for circulating thermal oil between the hot thermal oil storage tank 303 and the thermal oil heating system 307, are provided.

In an exemplary embodiment, the thermal oil heating system 307 may utilize solar heat to heat the thermal oil, e.g. using a solar concentrating device for directing solar radiation received at a first surface, e.g. a mirror or lens, to a second surface, e.g. a tube or array of tubes, which second surface is smaller than the first surface. Thermal oil may be circulated through a tube, which tube is arranged at or near a focal point of a mirror or lens allowing the thermal oil to absorb concentrated solar radiation.

However, other renewable energy sources may also be used, for instance geothermal heat. Although maybe not preferred, other renewable energy sources such as wind and the movement of water may also be used including a direct or indirect conversion to heat to allow the renewable energy source to heat thermal oil.

In the context of this application, nuclear power, either generated by nuclear fission or nuclear fusion, is also considered to be a renewable energy source.

In an embodiment, the renewable energy source is a sustainable energy source.

Preferably, the renewable energy sources do not require combustion to produce heat, i.e. the use of biogas or biofuel is not preferred.

The definition for waste energy source may be larger. Non-renewable or non-sustainable energy sources may be intended to produce one type of energy, but typically also produce other types of energy as a byproduct, usually in the form of heat. Also, factories using one type of energy may produce other types of energy as a byproduct. In case of heat, such energy sources or factories typically require cooling to remove the heat. Hence, byproducts of non-renewable or non-sustainable energy sources, but of course also of renewable or sustainable energy sources and factories, which otherwise would go to waste can be used as waste energy source in the context of this invention.

The cold thermal oil is circulated between the cold thermal oil storage tank 306 and the appliance 200 to provide cooling to the appliance 200. The cold thermal oil preferably has a predetermined operating temperature below 10 degrees Celsius, for instance 0-7 degrees Celsius for food and beverage use, in the cold thermal oil storage tank 306 and is supplied to the appliance 200 for heat exchange. After exchanging heat with the appliance 200, the cold thermal oil typically returns to the cold thermal oil storage tank at a higher temperature to be cooled again to the predetermined operating temperature.

To cool the cold thermal oil in the cold thermal oil storage tank 306 to the predetermined operating temperature and/or to maintain this temperature, an absorption cooling system 310 for cooling thermal oil using heat from a renewable energy source or waste energy source 311, and a cold thermal oil circulation system 312 for circulating thermal oil between the cold thermal oil storage tank 306 and the absorption cooling system 310, are provided.

The absorption cooling system 310 uses heat provided by the renewable energy source or the waste energy source 311, e.g. solar energy or waste heat from factories, to provide the energy needed to drive the cooling process. The cooling system 310 typically uses two coolants, the first of which performs evaporative cooling and is then absorbed into the second coolant. Heat is needed to reset the two coolants to their initial state. A heat exchanger then exchanges heat between the thermal oil and the first coolant.

As an alternative, the cooling system 310 may be an adsorption cooling system in which a coolant adsorbs onto the surface of a solid instead of dissolving into a second coolant. Again, heat is used to drive the cooling process.

In an exemplary embodiment, the cooling system 310 uses solar energy as a heat source, but may alternatively use another heat source, e.g. waste heat from other components in the system 100. As an example, hot thermal oil returning at the hot thermal oil inlet 302 may for instance first flow through the cooling system 310 to provide heat to drive the cooling system 310 before returning to the hot thermal oil storage tank 303. In principle this means that the same energy source is used to directly heat the hot thermal oil in the hot thermal oil storage tank 303 and indirectly to drive the cooling system 310 via the hot thermal oil.

Although theoretically not necessary per se, practical embodiments of the industrial scale power plant 300 require electrical energy, i.e. electricity, to power control units, sensors, actuators, lights, indicators, etc. The industrial scale power plant 300 therefore includes an electricity generating system 313 for converting energy from a renewable energy source or waste energy source 314 into electricity that is stored in a battery system 315.

The electricity generating system 313 may include solar panels, alternatively referred to as photovoltaic modules or photovoltaic elements, using sunlight as the renewable energy source to generate direct current electricity. The battery system 315 may include a converter to convert direct current electricity in alternating current electricity that can be provided to the abovementioned other components in the system requiring electrical power as indicated by arrow 316.

The electricity generating system 313 is deliberately designed and configured to have a significant overcapacity. The overcapacity can be used to compensate for variations in electricity generation that may be inherent to the renewable energy source or waste energy source 314, but also to generate and store excess energy to compensate for variations in the renewable or waste energy sources 309 and 311. For instance, the overcapacity during the day may be stored and used during the night, or the overcapacity during the summer may be stored and used during the winter.

To this end, the industrial scale power plant 300 comprises a hydrogen generating system 317 for converting electricity from the battery system 315 into hydrogen that can be stored in a hydrogen storage tank 318.

The hydrogen stored in the hydrogen storage tank 318 allows long-term storage of energy that can be used for generating heat and/or electricity at another time. Hydrogen is better for long-term storage over a regular battery system which is better for short-term storage, has a better energy density compared to a battery system, and can be used to store the energy for heating and/or electricity use in the future.

To generate heat, the power plant 300 comprises a hydrogen burner 319 for converting hydrogen from the hydrogen storage tank 318 into heat. This heat can then be used to heat the thermal oil in the hot thermal oil storage tank for instance using a second hot thermal oil circulation system 320 for circulating thermal oil between the hot thermal oil storage tank 303 and the hydrogen burner 319 for heating the thermal oil in the hot thermal oil storage tank 303. Alternatively, the hydrogen burner 320 may be arranged in the hot thermal oil circulation system 308 in series with or in parallel with the thermal oil heating system 307, or the hydrogen burner 320 may be arranged such that thermal oil in the hot thermal oil storage tank 303 is directly or indirectly heated via the hot thermal oil storage tank 303 using the hydrogen burner 320.

To generate electricity, the power plant 300 comprises a hydrogen battery 321, which may alternatively be referred to as fuel cell, for converting hydrogen from the hydrogen storage tank 318 into electricity. Although the hydrogen generating system 317 and the hydrogen battery 321 have been depicted as separate devices, it is very well possible that these devices are combined so that a single device or system is arranged for performing both functions, wherein such a device or system has a hydrogen generating mode for converting electricity in hydrogen and an electricity generating mode for converting hydrogen into electricity.

The hydrogen burner 319 which in this embodiment is used to generate heat to heat the thermal oil in the hot thermal oil storage tank 303 may additionally or alternatively be used to provide heat to the absorption or adsorption cooling system 310 to drive this cooling system as indicated using dashed arrow 323.

To control the power plant 300 a control system 322 is provided. To keep FIG. 1 clear, connections between the control system and the different components of the power plant 300 or parts thereof have been omitted.

The control system 322 is configured to control operation of the power plant 300 or part thereof to minimize environmental impact while being able to provide hot and cold thermal oil at any time. This means that the control system 322 ensures that the thermal oil in the hot thermal oil storage tank 303 and the cold thermal oil storage tank 306 are at their respective operating temperatures and that the battery system 315 and the hydrogen storage tank 318 are sufficiently filled. The control system 322 further has to make sure that energy that is required by the power plant 300 is generated using the renewable or waste energy sources 309, 311 and 314 as much as possible and that excess energy is stored as much as possible, preferably as hydrogen in the hydrogen storage tank 318.

When dimensioned and designed properly, it is possible to provide a power plant 300 that is able to meet the energy demand of the one or more appliances 200 and the power plant 300 itself throughout the year so that there is no connection necessary to a power grid or the necessity to provide or use fuel-based, non-sustainable, energy sources. Such connections or provisions may however be present to provide a fallback position in case of emergency or maintenance that is not intended to be used regularly. Hence, the system 100 is substantially self-sustaining during normal operation.

Figure 2:
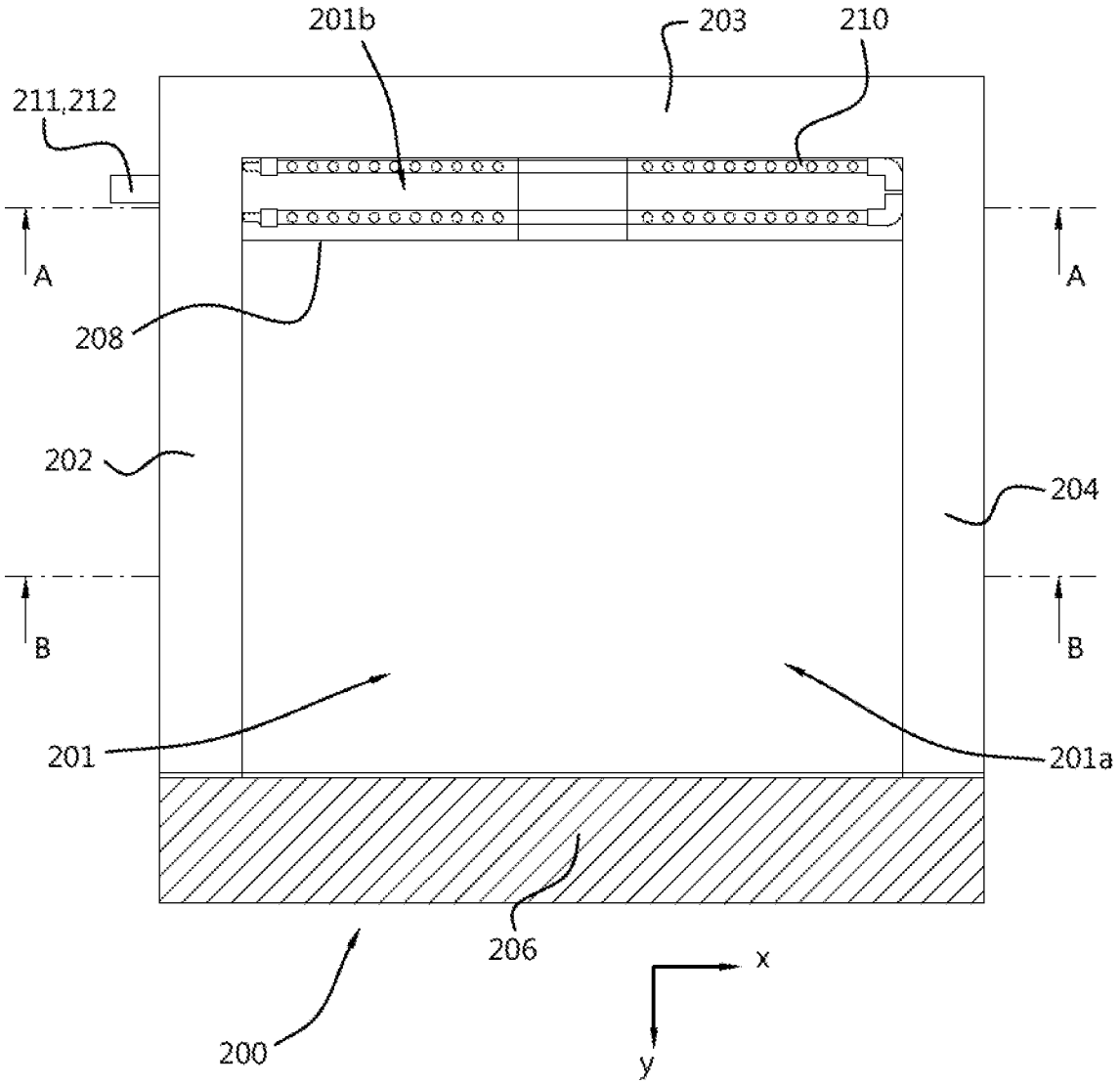
Figure 3:
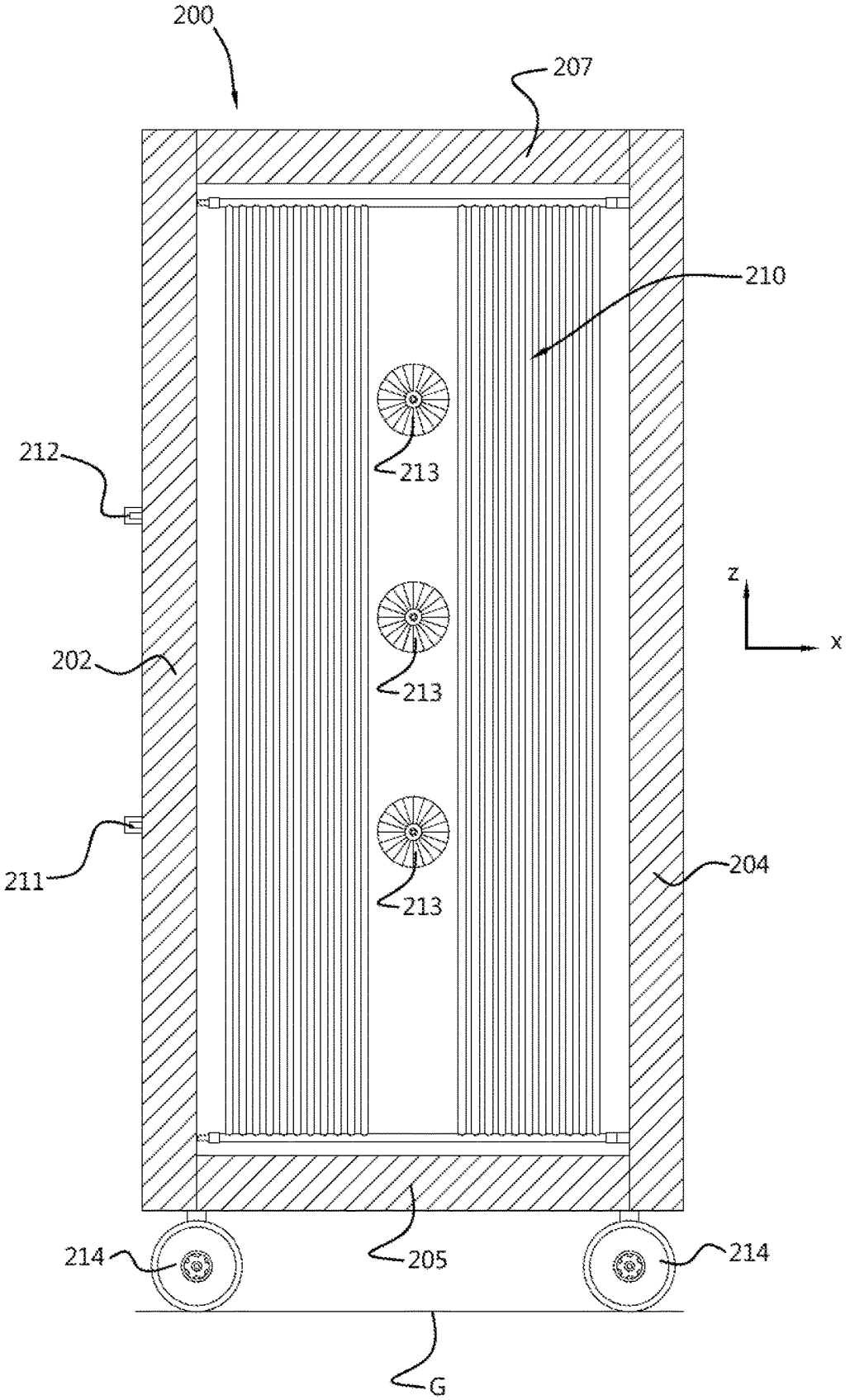
Figure 4:
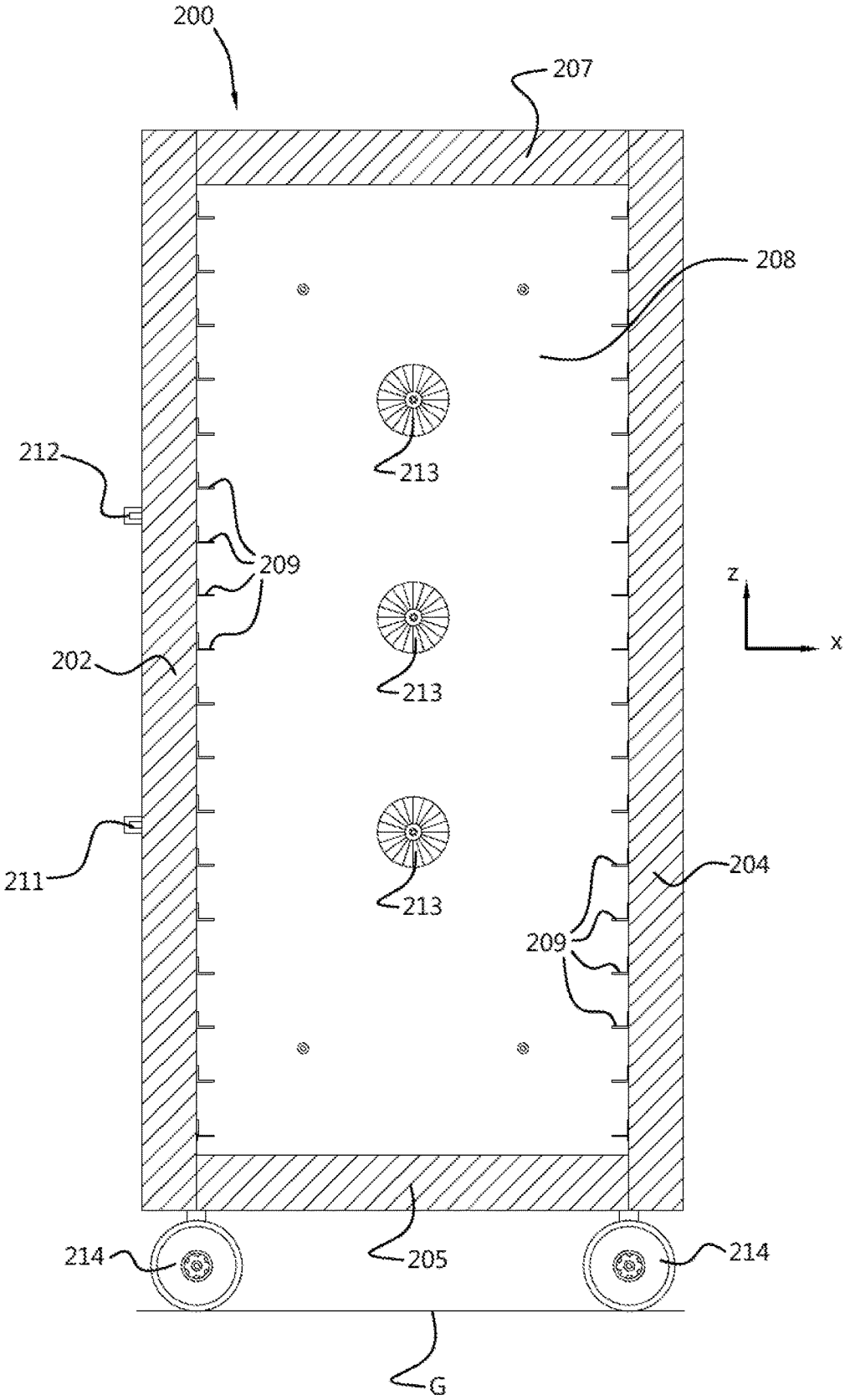

FIGS. 2-4 schematically depict a convection oven 200 that can be one of the appliances 200 mentioned in relation to the system 100 of FIG. 1. FIG. 2 depicts a cross-sectional view in a horizontal plane. FIG. 3 depicts a cross-sectional view in a vertical plane indicated as A-A in FIG. 2, and FIG. 4 depicts a cross-sectional view in a vertical plane indicated as B-B in FIG. 2.

The oven 200 has an inner space 201 enclosed by three fixed sidewalls 202, 203 and 204, a bottom wall 205, a door 206, and a top wall 207. The door 206 can be opened to gain access to the space 201, for instance to move products in and out of the space 201 or to inspect products in the space 201. For inspection it is also envisaged to use a window in the door 206.

The space 201 is divided by a vertical wall 208 into a first space 201*a* and a second space 201*b*. The vertical wall 208 is arranged parallel to sidewall 203 in this embodiment. The first space 201*a* is provided with supports 209 (see FIG. 4) allowing to support removable trays or racks with products to be baked or treated in the oven 200. Hence, the first space 201*a* may alternatively be referred to as the baking area 201*a*.

The second space 201*b* is used as a heating space to heat air using a radiator 210. The oven 200 is provided with a thermal oil inlet 211 and a thermal oil outlet 212. The thermal oil inlet 211 is configured to be connected to a hot thermal oil outlet of an industrial scale power plant, and the thermal oil outlet 212 is configured to be connected to a hot thermal oil inlet of an industrial scale power plant as for instance shown in FIG. 1. Hot thermal oil is then able to flow from the thermal oil inlet 211 through the radiator 210 to the thermal oil outlet 212. The radiator 210 consists of small tubes arranged in parallel able to heat the air inside space 201*b*.

Although not necessary per se, the small tubes of the radiator 210 are arranged in a vertical orientation, but a horizontal configuration would also work. Preferably, the hot thermal oil flows from a lower end of the radiator to an upper end of the radiator 210. As the temperature tends to drop when flowing through the radiator 210 as a result of heat exchange between the hot thermal oil and the air in the second space 210*b*, the temperature gradient and resulting density gradient in the radiator tubes will force the thermal oil in the right direction from inlet 211 to outlet 212 in case of an upward flow of hot thermal oil.

In this specific embodiment, the radiator 210 has a U-shape in plan view with one leg extending adjacent the sidewall 203 and the other leg extending adjacent the wall 208 thereby increasing the available radiator surface and the ability to transfer heat to the air inside the second space 201*b*.

The heated air inside the second space 201*b* is then moved to the first space 201*a* through three holes/openings in wall 208 by, in this embodiment, three corresponding ventilators 213. The ventilators 213 are in this embodiment centrifugal ventilators that draw in air in a radial direction and force the air into the first space 201*a* in an axial direction. The use of three ventilators 213 allows to distribute the warm air evenly through the first space 201*a* to get a uniform temperature distribution.

The oven 200 is supported from a ground G using wheels 214 allowing to easily move the oven 200 around.

The oven 200 is in this embodiment connected to the hot thermal oil supply of an industrial scale power plant as shown in FIG. 1. It is not necessary that the oven 200 is also connected to the cold thermal oil supply as shown in FIG. 1 for the appliance 200. The oven 200 may alternatively be connected to an industrial scale power plant similar to the industrial scale power plant 300 of FIG. 1 but with the difference that the industrial scale power plant 300 lacks a cold thermal oil storage tank 306, an absorption or adsorption cooling system 310 and cold thermal oil circulation system 312.

In this embodiment, the oven 200 of FIGS. 2-4 lacks active components like a pump or valves. Although not explicitly shown, the oven 200 may be equipped with one or more temperature sensors to measure the temperature inside the oven 200. Further, the thermal oil inlet 211 and outlet 212 may be configured to close automatically upon disconnecting the inlet 211 and outlet 212 from a hose or tube using a respective check valve.

Figure 5:
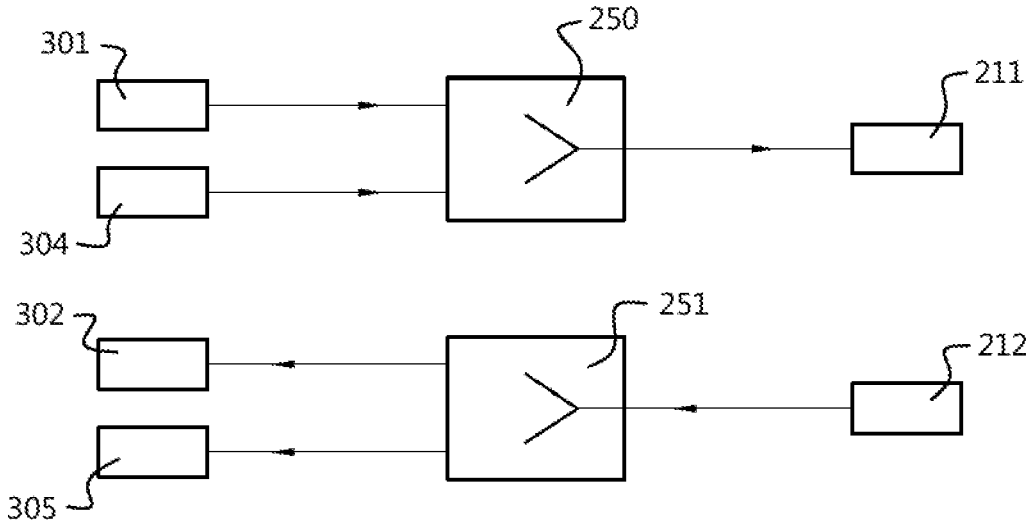

The oven 200 can also be connected to both the hot thermal oil supply and the cold thermal oil supply using a connection scheme as depicted in FIG. 5. Depicted in FIG. 5 are the hot thermal oil outlet 301, the cold thermal outlet 304, the hot thermal oil inlet 302, and the cold thermal oil inlet 305 of the power plant 300 of FIG. 1. Also depicted are thermal oil inlet 211 and thermal oil outlet 212 of the convection oven 200 of FIG. 2.

The hot thermal oil outlet 301 and the cold thermal oil outlet 304 are connected to a first valve device 250 via respective lines, and the first valve device 250 in turn is connected to the thermal oil inlet 211 via a single line. The thermal oil outlet 212 is connected to a second valve device 251 via a single line, and the second valve device 251 in turn is connected to the hot thermal oil inlet 302 and the cold thermal oil inlet 305 via respective lines.

The first and second valve devices 250, 251 are operated, e.g. by a control unit as part of the control system 322 of FIG. 1 or a separate control unit, to either connect the oven 200 to the hot thermal oil supply or the cold thermal oil supply. When the oven 200 is connected to the hot thermal oil supply, the oven can be heated, and when the oven 200 is connected to the cold thermal oil supply, the oven can be cooled. Using the cold thermal oil supply to cool the oven 200 results in much quicker cooling of the oven 200 as otherwise both the oven 200 and the thermal oil in the radiator have to cool down together. In this embodiment, the hot thermal oil is removed and replaced by cold thermal oil to cool the oven 200.

The temperature of the oven 200 can be controlled by adjusting the flow rate of the thermal oil supplied to the oven 200.

Although the connection scheme of FIG. 5 suggests that the connection is a separate component, but in alternative embodiments, the valve devices 250, 251 are part of the oven/appliance 200 or part of the power plant 300. In case of the latter situation, the power plant 300 still has a hot thermal oil inlet and outlet, and cold thermal oil inlet and outlet, but the inlets and outlets are shared by the hot thermal oil supply and the cold thermal oil supply.

Figure 6:
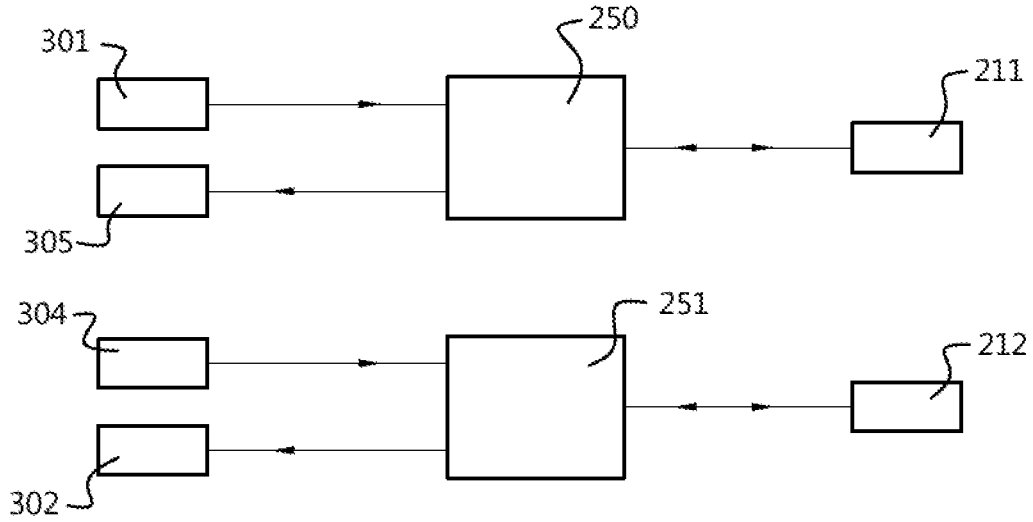

The oven 200 can further be connected to both the hot thermal oil supply and the cold thermal oil supply using an alternative connection schemas depicted in FIG. 6. Depicted in FIG. 6 are the hot thermal oil outlet 301, the cold thermal outlet 304, the hot thermal oil inlet 302, and the cold thermal oil inlet 305 of the power plant 300 of FIG. 1. Also depicted are thermal oil inlet 211 and thermal oil outlet 212 of the convection oven 200 of FIG. 2.

The hot thermal oil outlet 301 and the cold thermal oil inlet 305 are connected to a first valve device 250 via respective lines, and the first valve device 250 is connected to the thermal oil inlet 211 via a single line. The thermal oil outlet 212 is connected to a second valve device 251 via a single line, and the second valve device 251 in turn is connected to the hot thermal oil inlet 302 and the cold thermal oil outlet 304 via respective lines.

Hence, compared to the situation of FIG. 5, the cold thermal oil inlet 305 and the cold thermal oil outlet 304 have been connected to another one of the valve devices 250, 251.

The first and second valve devices 250, 251 are operated, e.g. by a control unit as part of the control system 322 of FIG. 1 or a separate control unit, depending on the demand of the appliance 200 or the power plant 300.

In a heating configuration, the first valve device 250 is operated to connect the hot thermal oil outlet 301 to the thermal oil inlet 211 and the second valve device 251 is operated to connect the hot thermal oil inlet 302 to the thermal oil outlet 212. In this way, the hot thermal oil from the power plant 300 is able to flow through the oven 200 to exchange heat and return to the power plant 300 for reheating.

In a cooling configuration, the first valve device 250 is operated to connect the cold thermal oil inlet 305 to the thermal oil inlet 211 and the second valve device 251 is operated to connect the cold thermal oil outlet 304 to the thermal oil outlet 212. In this way, the cold thermal oil from the power plant 200 is able to flow through the oven 200 to exchange heat and return to the power plant 300 for recooling. Note that due to the connection scheme of FIG. 6, the flow direction of the cold thermal oil through the appliance 200 is opposite to the flow direction of the hot thermal oil through the appliance 200. As explained above for the oven 200 of FIGS. 2-4, the hot thermal oil is preferably flowing from the bottom of the radiator to the top of the radiator as the temperature gradient and thus the density gradient will then aid in forcing the hot thermal oil through the radiator. As the temperature gradient and thus the density gradient is opposite when using cold thermal oil for cooling purposes, an opposite flow direction is then beneficial to obtain the same aiding in forcing the cold thermal oil through the radiator.

The connection scheme of FIG. 6 may further provide an advantage when the first and second valve devices 250, 251 also have an internal connection configuration allowing to connect the hot thermal oil outlet 301 to the cold thermal oil inlet 305, and/or allowing to connect the cold thermal oil outlet 304 to the hot thermal oil inlet 302. The benefit of the internal connection configuration is that the hot thermal oil storage tank 303 and the cold thermal oil storage tank 306 can be connected to each other. This provides the possibility to relatively quickly cool the hot thermal oil in the hot thermal oil storage tank using cold thermal oil from the cold thermal oil storage tank when using the internal connection configuration of the second valve device 251 and to relatively quickly heat the cold thermal oil in the cold thermal oil storage tank using hot thermal oil from the hot thermal oil storage tank when using the internal connection configuration of the first valve device 250. Only using one of the valve devices will result in a net transfer of thermal oil from one thermal oil storage tank to the other thermal oil storage tank which may for instance be beneficial to temporarily store all thermal oil in one tank to replace or apply maintenance to the other tank. Using both valve devices 250, 251 simultaneously has the benefit that there will be no significant net transfer of thermal oil from one tank to the other tank and the thermal oil volumes in the tanks are not affected, only the temperature.

Being able to relatively cool or heat thermal oil in a thermal oil storage tank may be beneficial when the temperature of the thermal oil in one (or both) of the thermal oil storage tanks exceeds a predetermined value and measures need to be taken to avoid a potentially dangerous situation. This risk is potentially higher for the thermal oil heating system where for instance an increase in solar intensity may give rise to a sudden increase in temperature of the thermal oil and the thermal oil heating system itself is not able to respond quickly enough.

Figure 7:
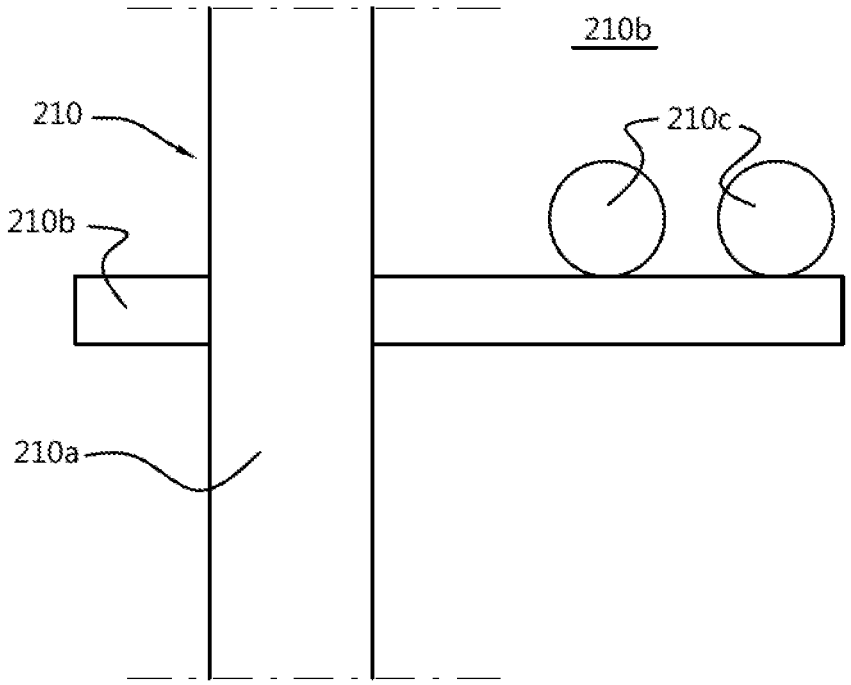

FIG. 7 depicts a detail of a radiator 210 that may be used in a convection oven similar to the oven shown in FIGS. 2-4. The radiator 210 includes a plurality of vertically arranged tubes 210*a* of which one is depicted in FIG. 7.

The radiator 210 of FIG. 7 includes a radiator fin 210*b* extending substantially perpendicular to the tube 210*a* into a second space 201*b* like the situation in FIGS. 2-4. The radiator fin 210*b* increases the area that can be used to transfer heat to the air in the second space 201*b*. A plurality of radiator fins 210*b* may be provided over the length of the tube 210*a*, for instance evenly distributed along the tube 210. The radiator fin 210*b* may be connected to two or more tubes 210 simultaneously but may also be connected to only one tube 210.

The radiator 210 of FIG. 7 further includes a plurality of thermal masses 210*c* connected to the tubes 210*a*, here via the radiator fins 210*b* to store thermal energy and to aid in providing a uniform temperature distribution in the second space 201*b*. Alternatively, the thermal masses 210*c* are connected to the tubes 210 directly. As with the radiator fins 210*b*, the thermal masses 210*c* may be connected to two or more tubes 210 simultaneously but may also be connected to only one tube 210.

The disclosure may be summarized by the following clauses:

1. An industrial scale power plant for providing hot thermal oil at a temperature above 100 degrees Celsius, e.g. between 100 and 500 degrees Celsius, for heating purposes and for providing cold thermal oil at a temperature of at most 10degrees Celsius, e.g. between −60 and 5 degrees Celsius, for cooling purposes, said power plant comprising:
   - a hot thermal oil storage tank,
   - a cold thermal oil storage tank,
   - a thermal oil heating system for heating thermal oil using heat from a renewable energy source or waste energy source,
   - an absorption or adsorption cooling system for cooling thermal oil using heat from a renewable energy source or waste energy source,
   - an electricity generating system for converting energy from a renewable energy source or waste energy source into electricity, which electricity generating system has a significant overcapacity,
   - a battery system for storing electricity,
   - a hydrogen storage tank,
   - a hydrogen burner for converting hydrogen into heat,
   - a hydrogen battery for converting hydrogen into electricity,
   - a hydrogen generating system for converting electricity into hydrogen,
   - a control system,
   - a hot thermal oil circulation system for circulating thermal oil between the hot thermal oil storage tank and the thermal oil heating system for heating the thermal oil in the hot thermal oil storage tank, and
   - a cold thermal oil circulation system for circulating thermal oil between the cold thermal oil storage tank and the absorption or adsorption cooling system for cooling the thermal oil in the cold thermal oil storage tank,
   - wherein the electricity generating system is configured to supply electrical components of the power plant with electrical power,
   - wherein the battery system is connected to the electricity generating system to store excess electricity in the battery system and to supply electrical components of the power plant with electrical power in case the power generated by the electricity generating system is not sufficient,
   - wherein the hydrogen generating system is connected to the electricity generating system to convert excess electricity into hydrogen,
   - wherein the hydrogen storage tank is connected to the hydrogen generating system to store generated hydrogen,
   - wherein the hydrogen burner is connected to the hydrogen storage tank to convert hydrogen into heat configured to be used to heat the thermal oil in the hot thermal oil storage tank and/or configured to drive the absorption or adsorption cooling system,
   - wherein the hydrogen battery is connected to the hydrogen storage tank to convert hydrogen into electricity configured to supply electrical components of the power plant with electrical power,
   - wherein the power plant further includes a hot thermal oil outlet and a hot thermal oil inlet connected to the hot thermal oil storage tank to provide hot thermal oil to an appliance,
   - wherein the power plant also includes a cold thermal oil outlet and a cold thermal oil inlet connected to the cold thermal oil storage tank to provide cold thermal oil to an appliance,
   - and wherein the control system is configured to control operation of the power plant, preferably to minimize environmental impact while being able to provide hot and cold thermal oil at any desired time.
2. An industrial scale power plant according to clause 1, wherein the thermal oil heating system is configured to absorb solar heat for heating the hot thermal oil.
3. An industrial scale power plant according to clause 2, wherein the thermal oil heating system includes a solar concentrating device for directing solar radiation received at a first surface of a mirror or lens to a second surface in contact with the hot thermal oil, which second surface is smaller than the first surface.
4. An industrial scale power plant according to any of clauses 1-3, wherein the absorption or adsorption cooling system is configured to absorb solar heat for driving the cooling system.
5. An industrial scale power plant according to any of clauses 1-4, wherein the electricity generating system comprises solar panels, i.e. photovoltaic elements, to convert solar radiation into electricity.
6. A system comprising:
   - one or more industrial appliances requiring heat to function,
   - an industrial scale power plant for providing heat to the one or more industrial appliances,
   - wherein the industrial scale power plant includes:
     - a hot thermal oil storage tank,
     - a thermal oil heating system for heating thermal oil using heat from a renewable energy source or waste energy source, an electricity generating system for converting energy from a renewable energy source or waste energy source into electricity, which electricity generating system has a significant overcapacity,
a battery system for storing electricity,
a hydrogen storage tank,
a hydrogen burner for converting hydrogen into heat,
a hydrogen battery for converting hydrogen into electricity,
a hydrogen generating system for converting electricity into hydrogen,
a control system, and
a hot thermal oil circulation system for circulating thermal oil between the hot thermal oil storage tank and the thermal oil heating system for heating the thermal oil in the hot thermal oil storage tank to a temperature above 100 degrees Celsius, e.g. between 100 and 500 degrees Celsius, wherein the electricity generating system is configured to supply electrical components of the power plant with electrical power, wherein the battery system is connected to the electricity generating system to store excess electricity in the battery system and to supply electrical components of the power plant with electrical power in case the power generated by the electricity generating system is not sufficient, wherein the hydrogen generating system is connected to the electricity generating system to convert excess electricity into hydrogen, wherein the hydrogen burner is connected to the hydrogen storage tank to convert hydrogen into heat configured to be used to heat the thermal oil in the hot thermal oil storage tank, wherein the hydrogen battery is connected to the hydrogen storage tank to convert hydrogen into electricity configured to supply electrical components of the power plant with electrical power, wherein the one or more appliances are connected to the hot thermal oil storage tank to receive and return hot thermal oil while extracting heat from the hot thermal oil, and wherein the control system is configured to control operation of the power plant, preferably to minimize environmental impact while being able to provide hot thermal oil at any desired time, and to control the amount of heat provided to the one or more appliances.

7. A system according to clause 6, wherein the one or more appliances include one or more of the following devices:
convection oven,
grill,
rack oven,
fruit dehydrator,
oil fryer,
water heater and house heater,
heat electricity generator,
water desalination system,
fermentation room,
pasteurizer,
dairy and cheese making device,
eggs hatching machine,
bacterial incubator.

8. A system according to clause 6 or 7, wherein the industrial scale power plant is an industrial scale power plant according to any of the clauses 1-5.

9. A system according to clause 8, wherein at least one of the one or more appliances are connected to the cold thermal oil storage tank to receive and return cold thermal oil while transferring heat to the cold thermal oil.

10. A convection oven comprising a first space and a second space separated from the first space via a wall, said first space being configured to support and hold items to be baked or heated, said second space being provided with a radiator for receiving hot thermal oil to heat air in the second space, and said wall separating the first and second space including an opening provided with a ventilator to move air from the second space to the first space.

11. A convection oven according to clause 10, wherein the radiator has a U-shape in plan view with one leg extending adjacent a sidewall opposite the wall separating the first and second space and the other leg extending adjacent said wall separating the first and second space.

12. A convection oven according to clause 10 or 11, wherein the wall separating the first and second space includes a plurality of openings, each opening being provided with a ventilator to move air from the second space to the first space.

13. A convection oven according to any of clauses 10-12, wherein the ventilator is a centrifugal ventilator drawing in air in a radial direction and forcing air out in an axial direction.

14. A method for providing hot thermal oil and cold thermal oil, said method comprising the following steps:
a. heating thermal oil using heat from a renewable or waste energy source and storing the heated thermal oil in a hot thermal oil storage tank,
b. driving an absorption or adsorption cooling system with heat from a renewable or waste energy source to cool thermal oil and storing the cooled thermal oil in a cold thermal oil storage tank,
c. generating electricity using a renewable or waste energy source, converting excess electricity into hydrogen, and storing the hydrogen in a hydrogen storage tank, and
d. in case heat from the renewable or waste energy source is insufficient for heating the thermal oil, converting hydrogen in the hydrogen storage tank into heat for heating thermal oil and storing the heated thermal oil in a hot thermal oil storage tank.

15. A method according to clause 14, wherein the method further comprises the step of converting hydrogen in the hydrogen storage tank into heat for driving the absorption or adsorption cooling system or using heated thermal oil from the hot thermal oil storage tank for driving the absorption or adsorption cooling system in case the heat from the renewable or waste energy source is insufficient for driving the absorption or adsorption cooling system.

Although the above examples and embodiments refer to oil, other fluids may also be used, e.g. fluids that are a solid at room temperature, e.g. molten salt.

The invention claimed is:

1. An industrial scale power plant for providing hot thermal fluid at a temperature above 100 degrees Celsius, and between 100 and 500 degrees Celsius, for heating purposes and for providing cold thermal fluid at a temperature of at most 10 degrees Celsius, and between-60 and 5 degrees Celsius, for cooling purposes, said power plant comprising:

a hot thermal fluid storage tank, a cold thermal fluid storage tank, a thermal fluid heating system for heating thermal fluid using heat from a renewable energy source or waste energy source, an absorption or adsorption cooling system for cooling thermal fluid using heat from the renewable energy source or waste energy source, an electricity generating system for converting energy from the renewable energy source or waste energy source into electricity, which electricity generating system has a significant overcapacity, a battery system for storing electricity, a hydrogen storage tank, a hydrogen burner for converting hydrogen into heat, a hydrogen battery for converting hydrogen into electricity, a hydrogen generating system for converting electricity into hydrogen, a control system, a hot thermal fluid circulation system for circulating thermal fluid between the hot thermal fluid storage tank and the thermal fluid heating system for heating the thermal fluid in the hot thermal fluid storage tank, and a cold thermal fluid circulation system for circulating thermal fluid between the cold thermal fluid storage tank and the absorption or adsorption cooling system for cooling the thermal fluid in the cold thermal fluid storage tank, wherein the electricity generating system is configured to supply electrical components of the power plant with electrical power, wherein the battery system is connected to the electricity generating system to store excess electricity in the battery system and to supply electrical components of the power plant with electrical power in case the power generated by the electricity generating system is not sufficient, wherein the hydrogen generating system is connected to the electricity generating system to convert excess electricity into hydrogen, wherein the hydrogen storage tank is connected to the hydrogen generating system to store generated hydrogen, wherein the hydrogen burner is connected to the hydrogen storage tank to convert hydrogen into heat configured to be used to heat the thermal fluid in the hot thermal fluid storage tank and/or configured to drive the absorption or adsorption cooling system, wherein the hydrogen battery is connected to the hydrogen storage tank to convert hydrogen into electricity configured to supply electrical components of the power plant with electrical power, wherein the power plant further includes a hot thermal fluid outlet and a hot thermal fluid inlet connected to the hot thermal fluid storage tank to provide hot thermal fluid to an appliance, wherein the power plant also includes a cold thermal fluid outlet and a cold thermal fluid inlet connected to the cold thermal fluid storage tank to provide cold thermal fluid to the appliance, and wherein the control system is configured to control operation of the power plant, to minimize environmental impact while being able to provide hot and cold thermal fluid at any desired time.

2. An industrial scale power plant according to claim 1, wherein the thermal fluid heating system is configured to absorb solar heat for heating the hot thermal fluid.

3. An industrial scale power plant according to claim 2, wherein the thermal fluid heating system includes a solar concentrating device for directing solar radiation received at a first surface of a mirror or lens to a second surface in contact with the hot thermal fluid, which second surface is smaller than the first surface.

4. An industrial scale power plant according to claim 1, wherein the absorption or adsorption cooling system is configured to absorb solar heat for driving the cooling system.

5. An industrial scale power plant according to claim 1, wherein the electricity generating system comprises solar panels, to convert solar radiation into electricity.

6. A system comprising:

one or more industrial appliances requiring heat to function, an industrial scale power plant for providing heat to the one or more industrial appliances, wherein the industrial scale power plant includes:

a hot thermal fluid storage tank, a thermal fluid heating system for heating thermal fluid using heat from a renewable energy source or waste energy source, an electricity generating system for converting energy from a renewable energy source or waste energy source into electricity, which electricity generating system has a overcapacity, a battery system for storing electricity, a hydrogen storage tank, a hydrogen burner for converting hydrogen into heat, a hydrogen battery for converting hydrogen into electricity, a hydrogen generating system for converting electricity into hydrogen, a control system, and a hot thermal fluid circulation system for circulating thermal fluid between the hot thermal fluid storage tank and the thermal fluid heating system for heating the thermal fluid in the hot thermal fluid storage tank to a temperature above 100 degrees Clesius, and between 100 and 500 degrees Celsius, wherein the electricity generating system is configured to supply electrical components of the power plant with electrical power, wherein the battery system is connected to the electricity generating system to store excess electricity in the battery system and to supply electrical components of the power plant with electrical power in case the power generated by the electricity generating system is not sufficient, wherein the hydrogen generating system is connected to the electricity generating system to convert excess electricity into hydrogen, wherein the hydrogen burner is connected to the hydrogen storage tank to convert hydrogen into heat configured to be used to heat the thermal fluid in the hot thermal fluid storage tank, wherein the hydrogen battery is connected to the hydrogen storage tank to convert hydrogen into electricity configured to supply electrical components of the power plant with electrical power, wherein the one or more appliances are connected to the hot thermal fluid storage tank to receive and return hot thermal fluid while extracting heat from the hot thermal fluid, and wherein the control system is configured to control operation of the power plant, to minimize environmental impact while being able to provide hot thermal fluid at any desired time, and to control the amount of heat provided to the one or more appliances.

7. A system according to claim 6, wherein the one or more appliances include one or more of the following devices:

convection oven,
grill,
rack oven,
fruit dehydrator,
oil fryer,
water heater and house heater,
heat electricity generator,
water desalination system,
fermentation room,
pasteurizer,
dairy and cheese making device,
eggs hatching machine,
bacterial incubator.

8. A system according to claim 6, wherein the industrial scale power plant is an industrial scale power plant according to claim 1.

9. A system according to claim 8, wherein at least one of the one or more appliances are connected to the cold thermal fluid storage tank to receive and return cold thermal fluid while transferring heat to the cold thermal fluid.

10. A method for providing hot thermal fluid and cold thermal fluid, said method comprising the following steps:

a. heating thermal fluid using heat from a renewable or waste energy source and storing the heated thermal fluid in a hot thermal fluid storage tank, b. driving an absorption or adsorption cooling system with heat from the renewable or waste energy source to cool thermal fluid and storing the cooled thermal fluid in a cold thermal fluid storage tank, c. generating electricity using the renewable or waste energy source, converting excess electricity into hydrogen, and storing the hydrogen in a hydrogen storage tank, and d. in case heat from the renewable or waste energy source is insufficient for heating the thermal fluid, converting hydrogen in the hydrogen storage tank into heat for heating thermal fluid and storing the heated thermal fluid in a hot thermal fluid storage tank.

11. A method according to claim 10, wherein the method further comprises the step of converting hydrogen in the hydrogen storage tank into heat for driving the absorption or adsorption cooling system or using heated thermal fluid from the hot thermal fluid storage tank for driving the absorption or adsorption cooling system in case the heat from the renewable or waste energy source is insufficient for driving the absorption or adsorption cooling system.

* * * * *